US006776547B1

(12) United States Patent
Dubois et al.

(10) Patent No.: US 6,776,547 B1
(45) Date of Patent: Aug. 17, 2004

(54) KEYBOARD HOUSING FOR A KEYPAD OF A PUSH-BUTTON KEYBOARD

(75) Inventors: Dieter Dubois, Augsburg (DE); Bernhard Gut, Aichach (DE)

(73) Assignee: Fujitsu Siemans Computers GmbH, München (DE)

( * ) Notice: Subject to any disclaimer, the term of this patent is extended or adjusted under 35 U.S.C. 154(b) by 234 days.

(21) Appl. No.: 10/049,620

(22) PCT Filed: Aug. 22, 2000

(86) PCT No.: PCT/DE00/02852

§ 371 (c)(1),
(2), (4) Date: Feb. 22, 2002

(87) PCT Pub. No.: WO01/14947

PCT Pub. Date: Mar. 1, 2001

(30) Foreign Application Priority Data

Aug. 24, 1999 (DE) ..... 199 40 051

(51) Int. Cl.[7] ..... B41J 5/28

(52) U.S. Cl. ..... 400/496; 345/168; 400/490; 400/495; 200/5 R; 200/520

(58) Field of Search ..... 345/156, 168; 200/5 R, 5 B, 5 C, 5 EB, 6 BA, 344, 520; 463/37; 341/20, 22, 24; 400/490, 495, 496

(56) References Cited

U.S. PATENT DOCUMENTS

| | | | | | |
|---|---|---|---|---|---|
| 3,720,801 | A | | 3/1973 | Yanaga | |
| 4,010,838 | A | | 3/1977 | Sims, Jr. | |
| 4,771,146 | A | | 9/1988 | Suzuki et al. | |
| 5,668,358 | A | * | 9/1997 | Wolf et al. | 200/5 A |
| 5,669,723 | A | * | 9/1997 | Chang | 400/496 |
| 5,823,325 | A | * | 10/1998 | Lin | 200/344 |
| 5,941,373 | A | * | 8/1999 | Cheng | 200/344 |
| 6,020,566 | A | * | 2/2000 | Tsai | 200/344 |
| 6,022,157 | A | * | 2/2000 | Shih-Hung | 400/490 |
| 6,057,522 | A | * | 5/2000 | Chao | 200/344 |
| 6,100,482 | A | * | 8/2000 | Koma et al. | 200/344 |
| 6,268,578 | B1 | * | 7/2001 | Nakai | 200/520 |
| 6,400,357 | B1 | * | 6/2002 | Chao | 345/168 |
| 6,495,782 | B1 | * | 12/2002 | Huang | 200/341 |
| 6,509,536 | B2 | * | 1/2003 | Sasaki | 200/344 |

FOREIGN PATENT DOCUMENTS

| | | |
|---|---|---|
| DE | 87 08 373 | 8/1987 |
| EP | 0 271 124 | 6/1988 |
| EP | 0 304 847 | 3/1989 |
| EP | 0 354 312 | 2/1990 |

* cited by examiner

*Primary Examiner*—Henry N. Tran
(74) *Attorney, Agent, or Firm*—Cohen, Pontani, Lieberman & Pavane

(57) ABSTRACT

A keyboard housing for a key array of a depressible-key keyboard. A parallel guide for multi-wide keys is configured in such a way in the keyboard housing that a swiveling crank arm is limited against longitudinal displacement at both ends and, by two support ribs, is positioned in a vertical direction that its position corresponds precisely to that of the depressed multi-wide key. If the complete set of keys is inserted into the housing and pressed as far as the end stop, the swiveling crank arm latches into snap-in apertures of the multi-wide key, thus becoming functional. The keyboard housing can be used for keyboards produced by automation.

9 Claims, 8 Drawing Sheets

KEYBOARD HOUSING FOR A KEYPAD OF A PUSH-BUTTON KEYBOARD

RELATED APPLICATIONS

This is a U.S. national stage of application No. PCT/DE00/02852, filed on Aug. 22, 2000.

This patent application claims the priority of German patent Application No. 199 40 051.2 filed Aug. 24, 1999, the disclosure content of which is hereby incorporated by reference.

FIELD OF THE INVENTION

The invention relates to a keyboard housing for a keypad of a push-button keyboard.

BACKGROUND OF THE INVENTION

From European Patent 0304847 B1 there is known a depressible key for a key array of a keyboard with a housing disposed on a base plate and with an elongate key body which, in its longitudinal direction, is disposed parallel to the base plate and is connected to a plunger, which is guided axially in a housing shaft and to which a swiveling crank arm is fastened. This swiveling crank arm is provided with two crank-arm rods running parallel to the longitudinal direction of the key body and held at a fixed distance from one another by a connecting element, the first being mounted in bearing elements constructed as snap-in elements on the key body and the second crank-arm rod comprising two rod stubs, which are mounted in two lateral receiving elements, each constructed as horizontal parallel slideways.

The swiveling crank arm is provided in order to transfer, during actuation of the depressible key at one end of the key body, part of the actuating force to the other end of the key body, thus preventing the tilting of the key body that would lead to jamming of the plunger connected to the key body in its guide, whereby the function of the depressible key would ultimately be compromised. For the purpose of easier assembly of the depressible key equipped with the elongate key body, there is provided according to European Patent 0304847 B1, on the base plate, at least one downslide which forces the second crank-arm rod out of its engaged position in transverse direction of the key body and feeds it to the receiving elements during introduction of the plunger into the housing shaft. By virtue of this known feature the depressible key can indeed by assembled by a single one-dimensional movement, which can even be accomplished with a special machine. Final assembly, however, is possible only if the swiveling crank arm together with its first crank-arm rod has already been engaged beforehand with the key body in the snap-in apertures provided for the purpose, and thus has been preassembled. Thus combined and simultaneous complete assembly of the multiwide key together with the other keys provided for the keyboard is not possible.

Because of the large number of modern keyboards now being made, however, the greatest possible degree of automation is desired for their production. For example, it is now common practice to make all keys of a keyboard by one-shot injection molding and, by means of a manipulator, to introduce them directly from the injection-molding machine into the keyboard housing in the fitting operation. However, the multi-wide keys with swiveling crank arm of the type described in European Patent 0304847 B1, for example, are not included in this process. Because of the complicated assembly of such multi-wide keys with parallel guide crank arm, the operation of fitting the keyboard housing therewith is usually performed entirely by hand or, after the swiveling crank arm has been manually mounted beforehand on the depressible key, is accomplished by means of a special assembly tool in a separate subsequent assembly process.

SUMMARY OF THE INVENTION

The object of the invention is to provide measures which make it possible to include even the key bodies of the multi-wide keys in the injection-molding mold of the depressible keys of the keyboard and, by means of the manipulator, to introduce all key bodies of a keyboard array, including the multi-wide bodies, directly from the injection-molding machine into the keyboard housing for the fitting operation.

This and other objects are attained in accordance with one aspect of the present invention directed to a keyboard housing assembly for a key array of a depressible-key keyboard, comprising a keyboard housing, and a swiveling crank-arm. The keyboard housing is adapted to accommodate at least one depressible multiwide key with a key body elongated in a longitudinal direction and having a first plunger adapted to be guided axially in a shaft of the housing against action of a spring. The multiwide key is adapted to be fastened, in a region of both of its longitudinal ends, to the swiveling crank-arm. The swiveling crank-arm has first and second crank-arm rods running parallel to the longitudinal direction and held at a fixed distance from one another by connecting elements, the first crank-arm rod being adapted to be mounted in bearing elements constructed as snap-in apertures on the key body, and the second crank-arm rod comprising two rod stubs, which are mounted in two lateral receiving elements of the keyboard housing. The swiveling crank-arm is received in the keyboard housing so that its rest position prior to installation of the multiwide key corresponds to that position at which it is located when mounted in the bearing elements and with the multi-wide key body being depressed.

The parallel guide for the multi-wide key is configured in such a way in the keyboard housing according to the invention that the swiveling crank are can be precisely inserted therein in an extremely simple manner.

This parallel guide is advantageously constructed such that the swiveling crank-arm is limited immovably in the longitudinal direction at both ends, and by means of the support ribs is so positioned in the vertical direction that its position corresponds to that of the depressed multi-wide key. If the complete set of depressible keys of a key array is now inserted into the keyboard housing and pressed as far as the end stop, the swiveling crank-arm, precisely introduced beforehand into the keyboard housing, latches into the bearing elements of the multi-wide key provided for the purpose and constructed as snap-in apertures, thus becoming functional.

It is sufficient to provide on the keyboard housing two support ribs, which are disposed at such positions in the upper region of the keyboard housing that the swiveling crank arm together with its two axial end regions naturally rests on them. These two support ribs can be so disposed in the upper region of the keyboard housing that the two connecting elements of the swiveling crank arm naturally rest on them at points close to the first crank-arm rod.

The two lateral receiving elements constructed respectively as horizontal parallel slideways for the two rod stubs of the swiveling crank arm are advantageously provided with a lower horizontal slideway face and an upper horizontal slideway face respectively, which are spaced apart from one another by a distance corresponding to the thickness of the swiveling crank arm. The two receiving elements each contain an L-shaped aperture, so that the respective rod stub of the swiveling crank arm can be introduced between the two slideway faces and, in an action simultaneously coordinated therewith, the connecting element in question of the swiveling crank arm can be introduced in an oblique orientation. The outer lateral edges of these two L-shaped apertures are so disposed that the distance between them corresponds to the length of the swiveling crank arm in longitudinal direction, or in other words to the spacing between the outsides of the connecting elements of the swiveling crank arm. By these features it is ensured on the one hand that the two rod stubs of the swiveling crank arm can be displaced slidingly during insertion into the two receiving elements comprising the parallel guide, and on the other hand that the swiveling crank arm is securely limited against longitudinal displacement.

The features and improvements indicated in the foregoing, which relate to mounting of the multi-wide key body together with its swiveling crank arm on the keyboard housing, are preferably provided in the region of its two ends and, in fact, in mirror-image manner relative to its central plane oriented perpendicular to the longitudinal direction. By this measure and, in a further expedient version, also by the measure that auxiliary plungers guided axially in associated housing shafts are disposed on the key body on both sides of and parallel to the centrally disposed plunger, tilting of the key body is reliably prevented.

BRIEF DESCRIPTION OF THE DRAWINGS

A practical example of the invention, in which the subject multi-wide key together with the elongate key body is the space bar of a keyboard, is explained hereinafter on the basis of drawings, wherein.

DETAILED DESCRIPTION OF THE DRAWINGS

Figure 1:
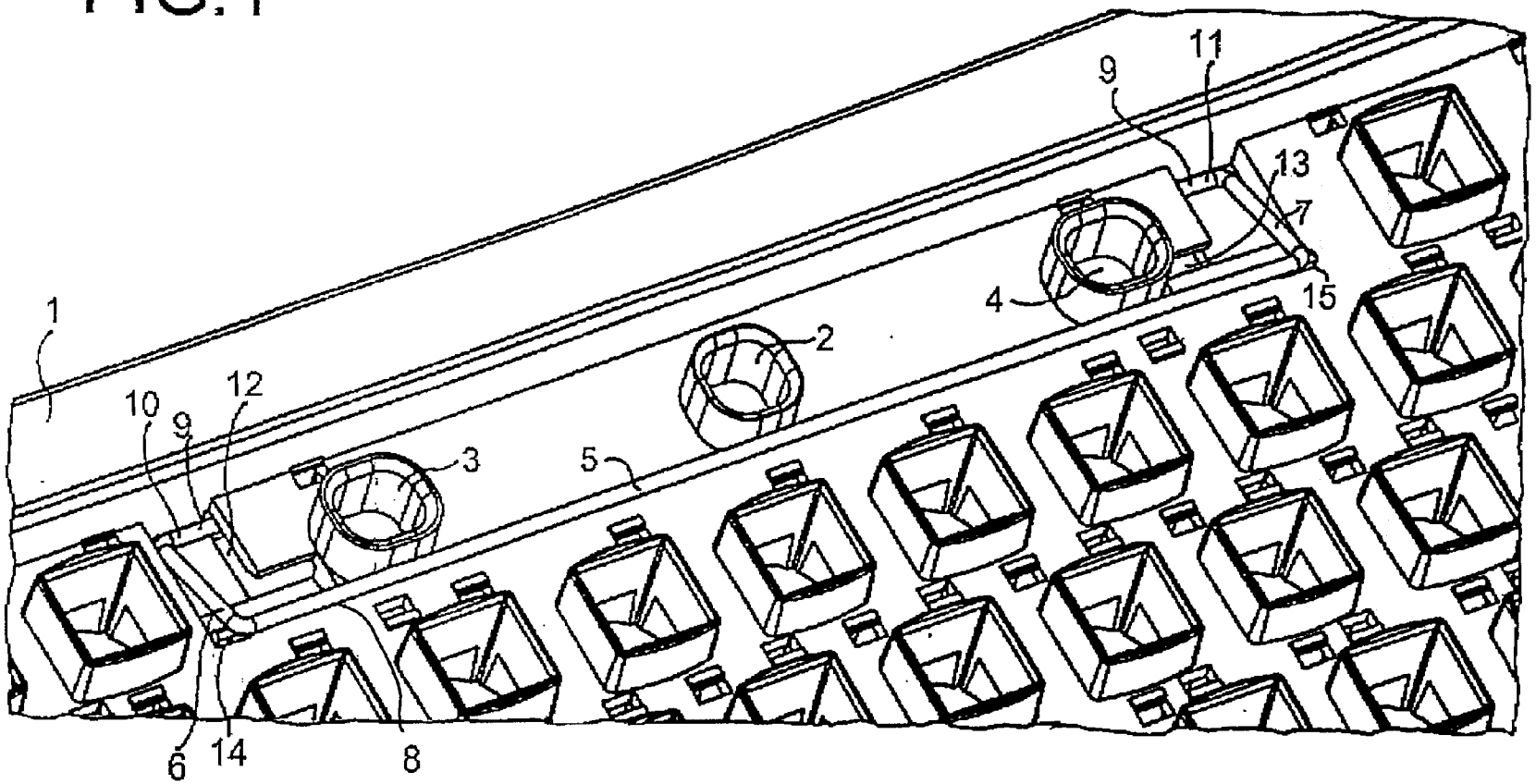
FIG. 1 shows a perspective view obliquely from below of a keyboard housing designed according to the invention, in which the swiveling crank arm has been inserted but which has not yet been fitted with keys.
Figure 2:
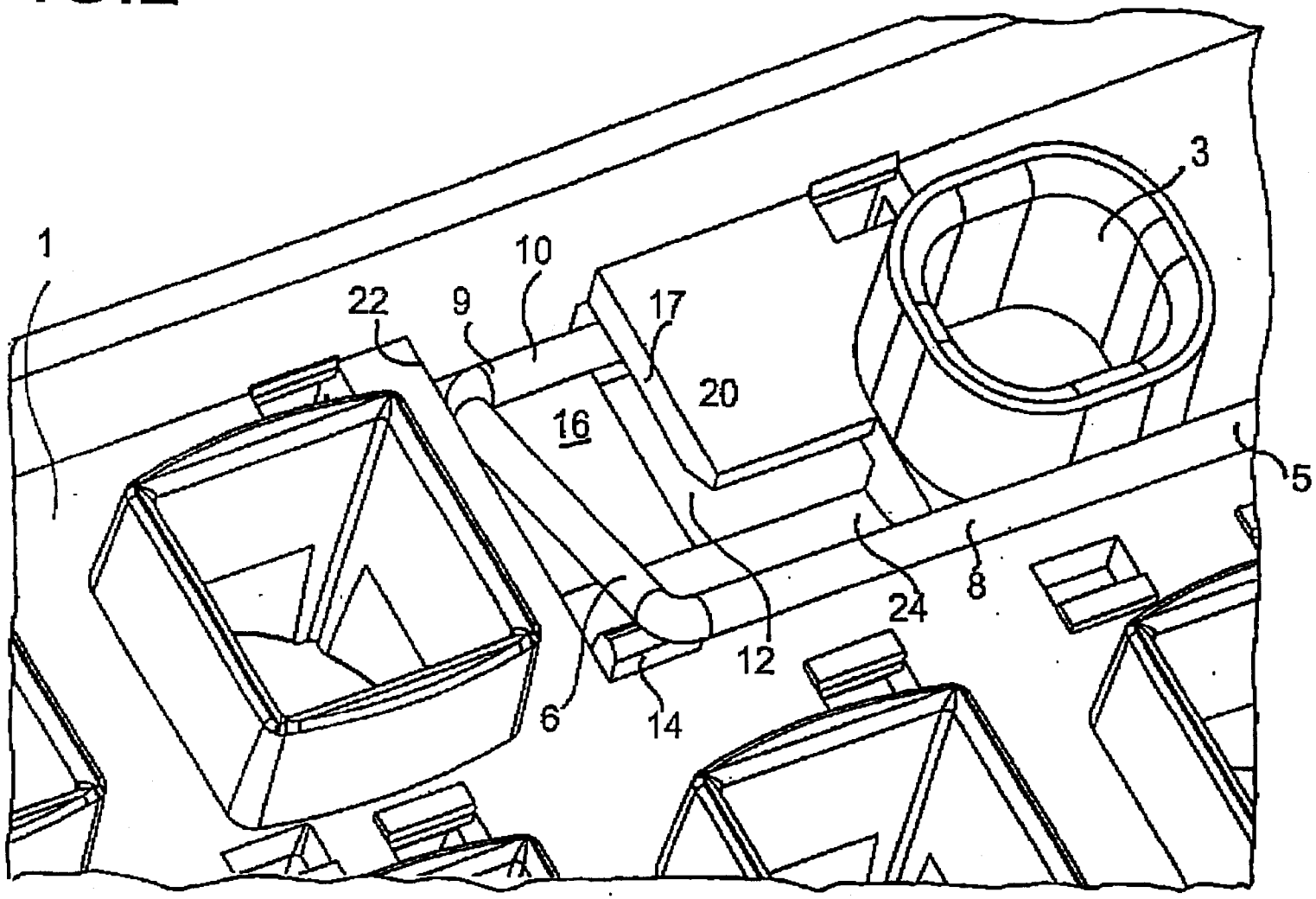
FIG. 2 shows a first detail of the perspective view illustrated in FIG. 1.
Figure 3:
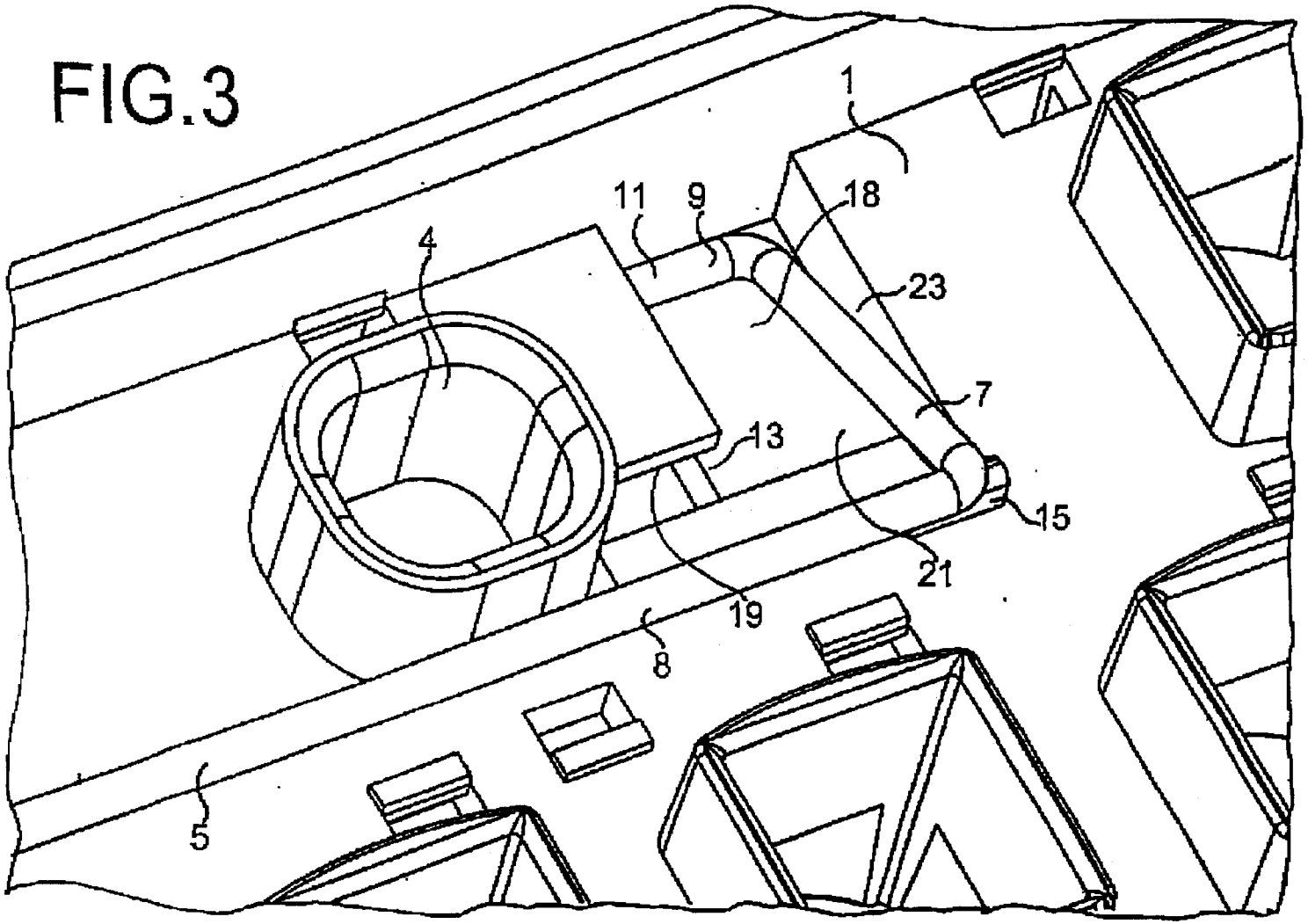
FIG. 3 shows a second detail of the perspective view illustrated in FIG. 1.

Before the description of the practical begins, it is pointed out that, for reasons of clarity, some of the reference symbols mentioned in connection with the explanation of FIG. 1 appear only in FIGS. 2 and 3, which show details of FIG. 1 which are important for the invention and are therefore enlarged.

In FIG. 1 there is illustrated a keyboard housing 1 for a key array, which housing is intended to contain a space bar constructed as a multi-wide key. To receive one central and two lateral plungers of this multi-wide key, there are provided in keyboard housing 1 three housing shafts 2, 3 and 4, in which the plungers protruding perpendicularly downward from the elongate key body (not illustrated in FIG. 1) are axially guided and at least the central plunger impinges with its end on a spring element.

Figure 6:
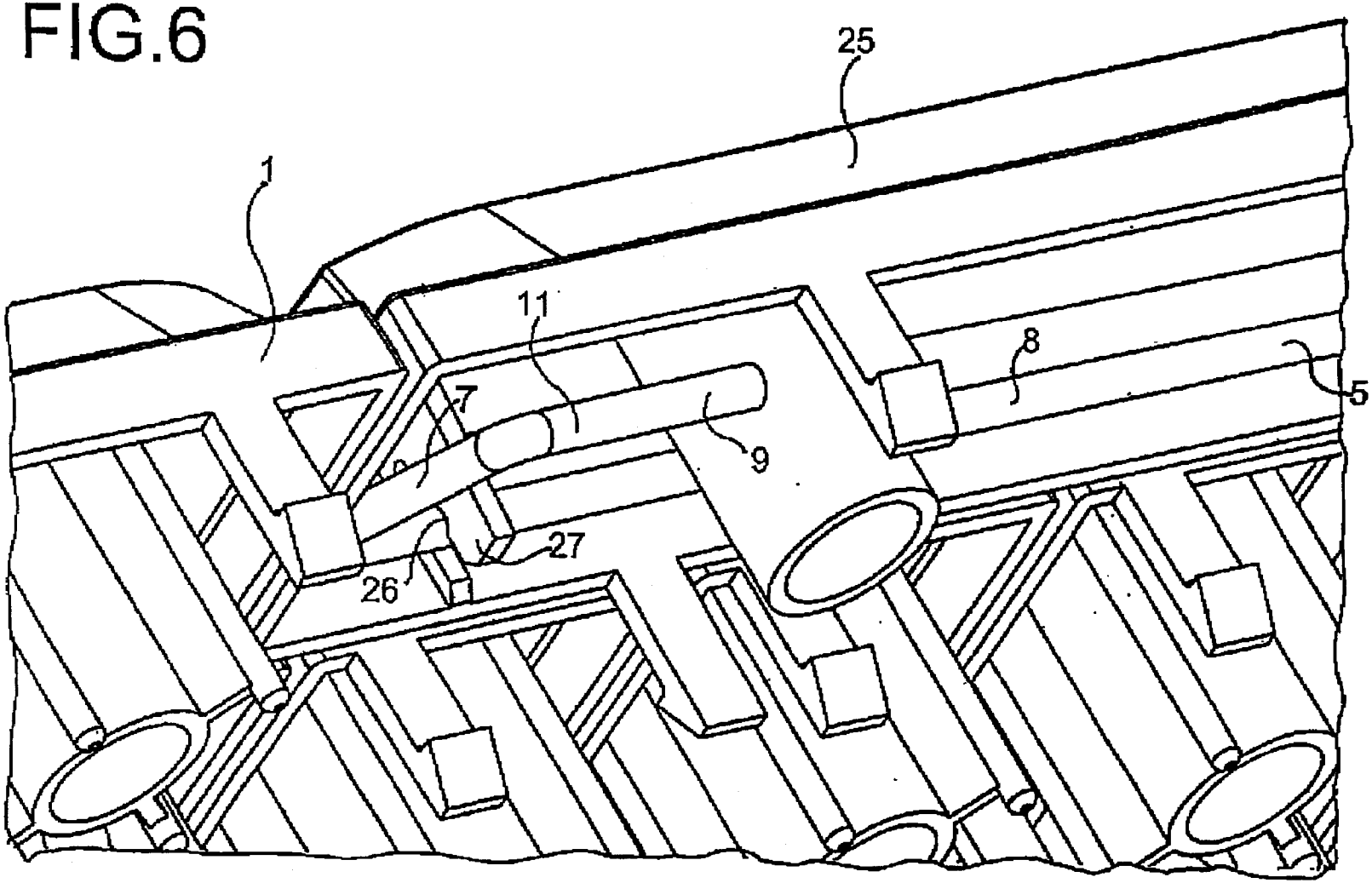
FIG. 6 shows a perspective view obliquely from below of the set of keys for the keyboard housing.

To prevent tilting of the elongate depressible-key body there is provided a swiveling crank arm 5, which is provided with two crank-arm rods 8 and 9 running parallel to the longitudinal direction and held at a fixed distance from one another by connecting elements 6 and 7, first crank-arm rod 8 being mounted in bearing elements on the key body, as will be further explained hereinafter in connection with FIGS. 6 to 8, and second crank-arm rod 9 comprising two rod stubs 10 and 11, which are mounted in two lateral receiving elements 12 and 13, each constructed as a horizontal parallel slideway. The two receiving elements 12 and 13 provided respectively as the bearing for rod stubs 10 and 11 respectively of swiveling crank arm 5 are configured such that swiveling crank arm 5 has at both ends a limited range of movement in longitudinal direction. In the upper region of keyboard housing 1 there are provided, as rests for swiveling crank arm 5, two support ribs 14 and 15, the position and height of which are chosen such that the position of swiveling crank arm 5 in resting condition corresponds to its position when the multi-wide key is depressed. The two support ribs 14 and 15 are disposed in such a way in the upper region of keyboard housing 1 that the two connecting elements 6 and 7 of swiveling crank arm 5 naturally rest on them at points disposed close to first crank-arm rod 8.

As shown in FIG. 2 (receiving element 12) and in FIG. 3 (receiving element 13) respectively, the two lateral receiving elements 12 and 13 constructed respectively as horizontal parallel slideways for the two rod stubs 10 and 11 of swiveling crank arm 5, are provided with lower horizontal slideway faces 16 and 18 respectively and with upper horizontal slideway faces 17 and 19 respectively, which are spaced apart from one another by a distance corresponding to the thickness of swiveling crank arm 5. The two receiving elements 12 and 13 contain L-shaped apertures 20 and 21 respectively in order that the respective rod stub 10 and 11 of swiveling crank arm 5 can be introduced between the two parallel slideway faces 16, 17 and 18, 19 respectively and, in an action simultaneously coordinated therewith, connecting elements 6 and 7 respectively of swiveling crank arm 5 can be introduced in an oblique orientation.

Figure 4:
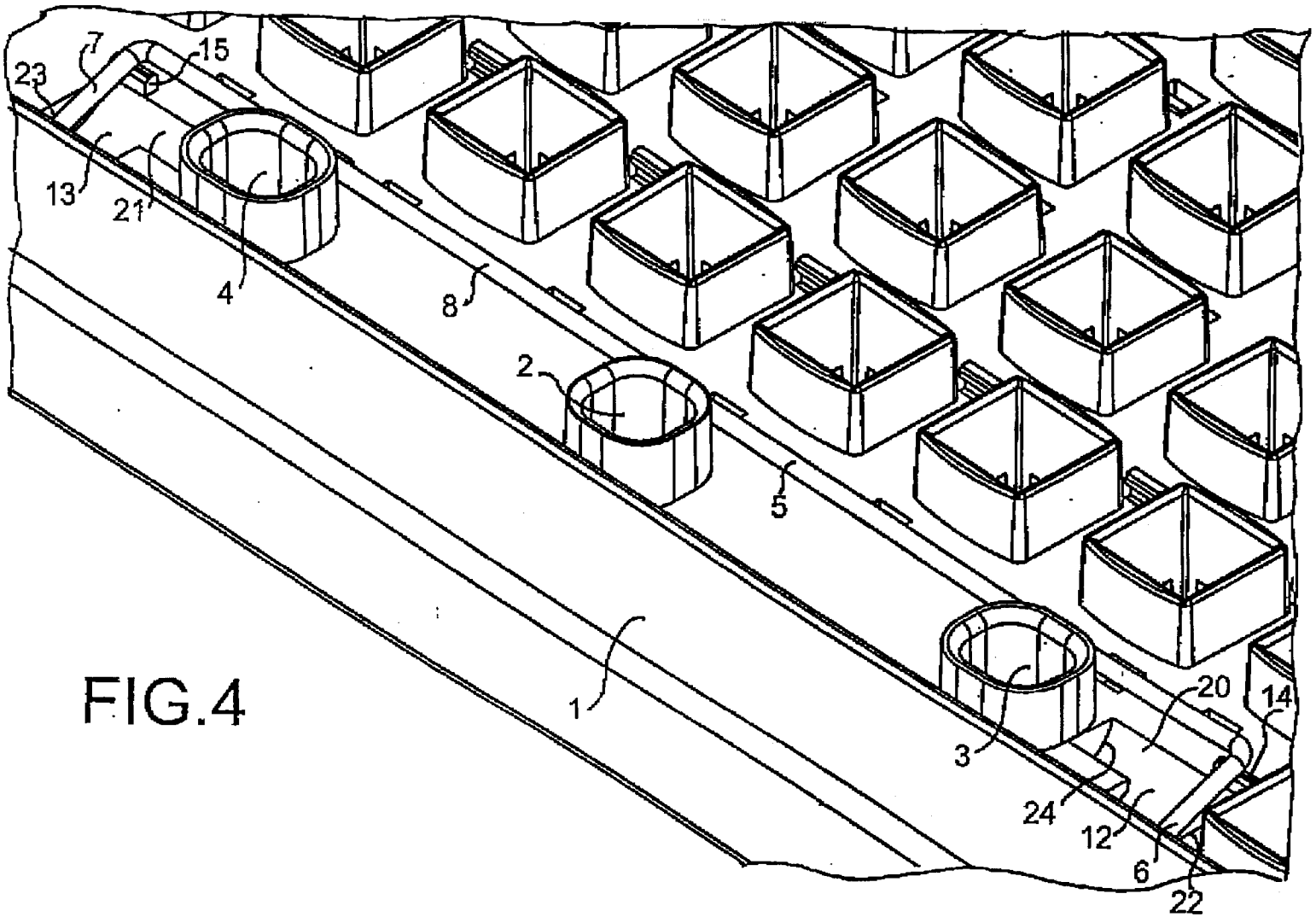
FIG. 4 shows another perspective view obliquely from above of the same keyboard housing designed according to the invention, in which the swiveling crank arm has been inserted but which once again has not yet been fitted with keys.

Outer lateral edges 22 and 23 of these two L-shaped apertures 20 and 21 are disposed such that the distance between them corresponds to the length of swiveling crank-arm 5 in the longitudinal direction, or in other words to the distance between the outsides of connecting elements 6 and 7 of the swiveling crank-arm 5. By this construction of connecting elements 6 and 7 as well as the position and height selected for support ribs 14 and 15, it is ensured on the one hand that the two rod stubs 10 and 11 of swiveling crank-arm 5 can be displaced slidingly during insertion into the two receiving elements 12 and 13 comprising the parallel guide, and on the other hand that swiveling crank-arm 5 can be limited securely against longitudinal displacement. As the perspective view of FIG. 4 shows for receiving into the element 12, rod stubs 10 and 11 can be introduced easily into the parallel guide comprising lower horizontal slideway face 16 and upper slideway face 17, since a rounded downslide 24 is provided for this purpose in front of the respective lower horizontal slideway face 16 in question.

Figure 5:
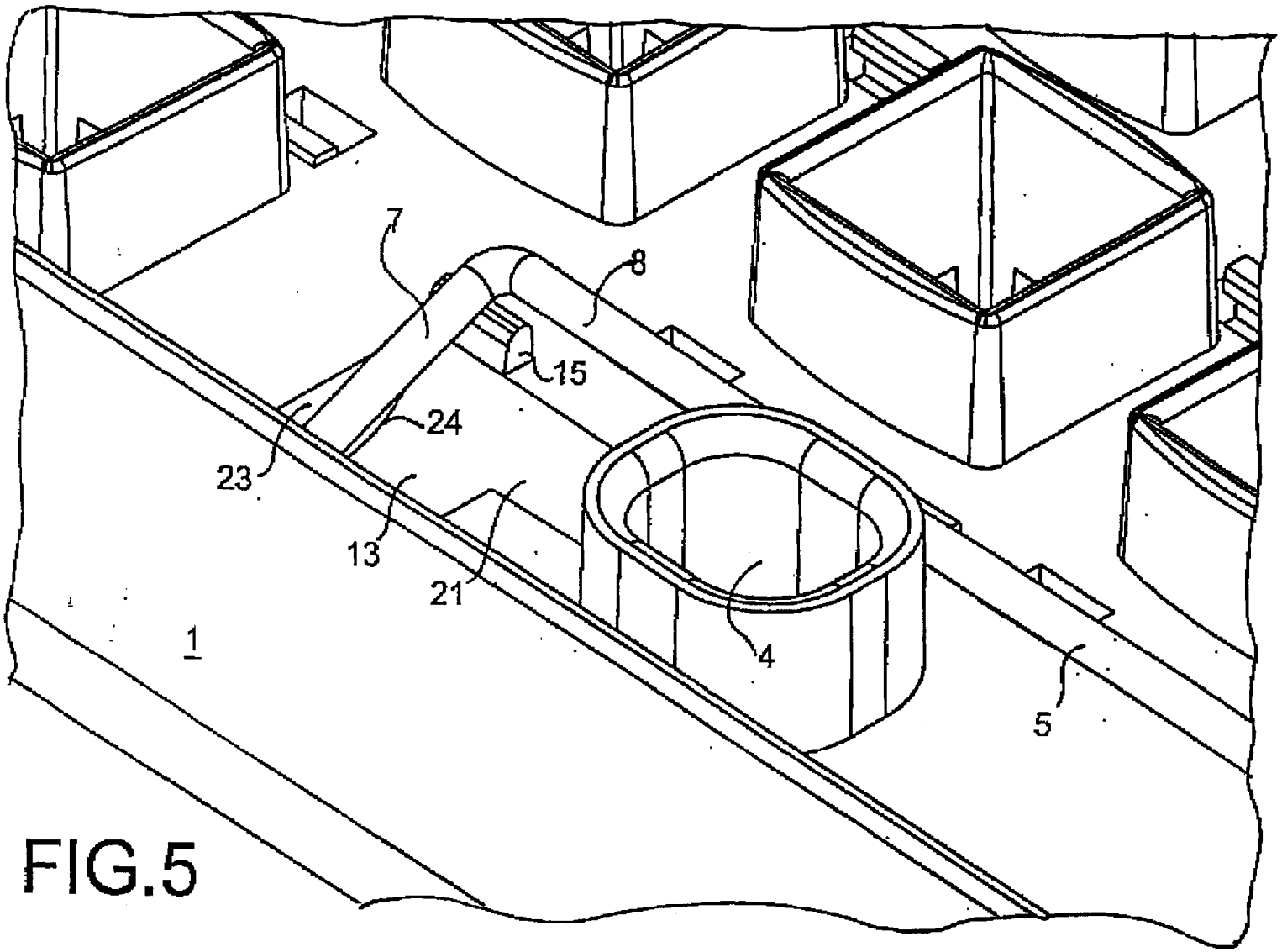
FIG. 5 shows a detail of the perspective view illustrated in FIG. 4.

The construction of the parallel guide of swiveling crank arm 5 together with its rod stubs 10 between the two slideway faces 16 and 17 is clearly evident in particular in FIG. 2, which is illustrated for receiving element 12. From FIG. 5, which is illustrated for the side of receiving element 13, it is clear on the one hand how, in particular, swiveling crank arm 5 is limited against longitudinal displacement by lateral edge 22, and on the other hand how support rib 15 is positioned, on which rib connecting element 7 naturally rests in such a way that, during assembly of the key, which takes place by pressing from above, first crank-arm rod 8 has a height such that the multi-wide key latches by means of its snap-in aperture with first crank-arm rod 8 against support rib 15 under the resistance of swiveling crank arm 5.

This latched condition of a multi-wide key body 25 is illustrated for one end side of this key in FIG. 6, which shows the upper part of keyboard housing 1 from below. First crank-arm rod 8 of swiveling crank arm 5 is mounted in a bearing element 27 on key body 28, the bearing element being equipped with a snap-in aperture 26. In the illustration of FIG. 6, rod stub 11 is free since, for reasons of easier understanding, the lower part of the keyboard housing containing the parallel guide has not been attached.

Figure 7:
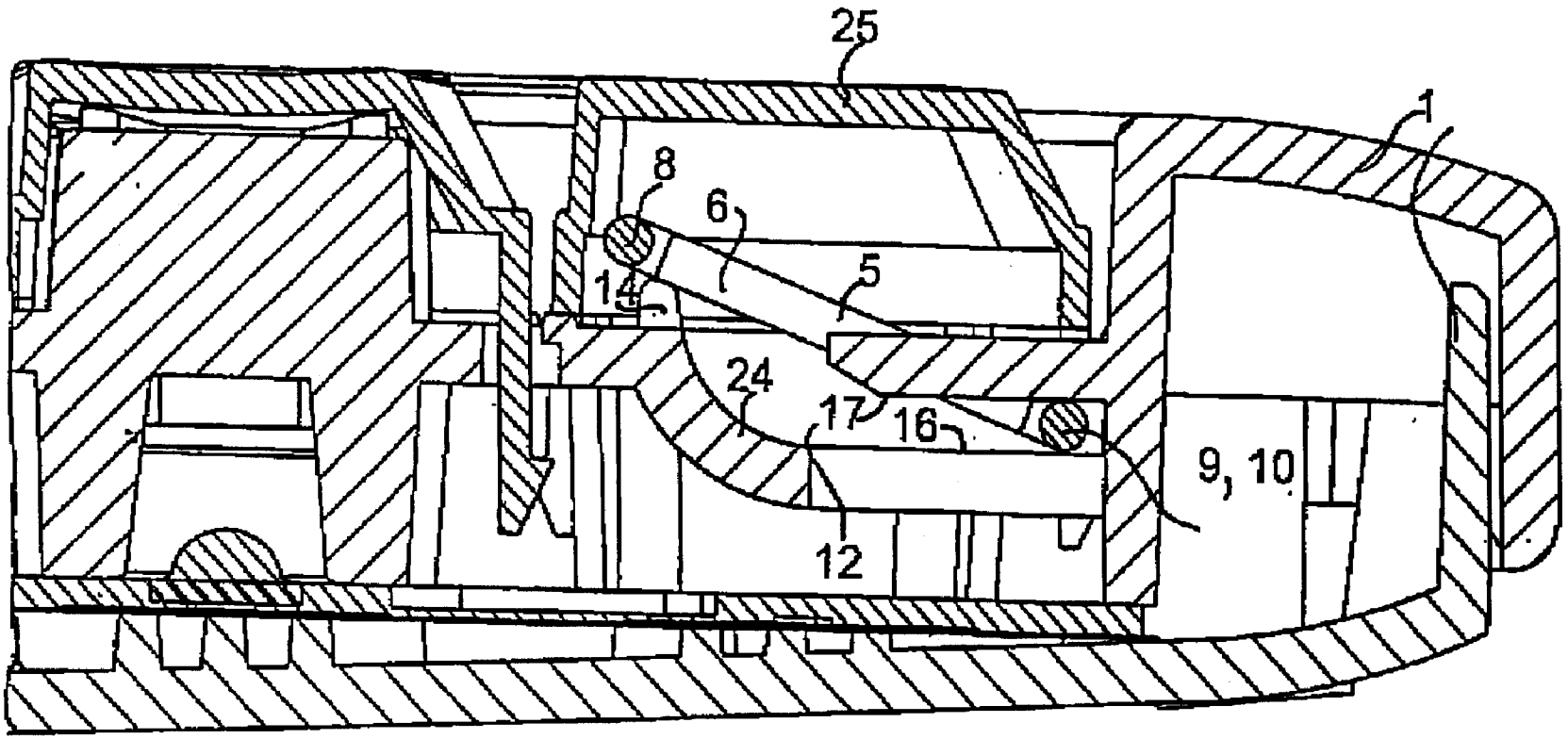
FIG. 7 shows a cross-sectional view through the keyboard fitted in finished condition, the sectional plane through the space bar being chosen to display one support rib and the parallel guide for the swiveling crank arm.

In the sectional view in FIG. 7, swiveling crank arm 5, braced with its connecting element 6, rests on support rib 14. Multi-wide key body 25, together with its snap-in aperture 26, which is visible in FIG. 8, can latch with first crank-arm rod 8 of swiveling crank arm 5. The parallel guide of rod stub 10 between lower horizontal slideway face 16 and upper horizontal slideway face 17 is clearly evident in FIG. 7. Also clearly evident is rounded downslide 24 for easier introduction of rod stub 10 between the two horizontal slideway faces 16 and 17.

Figure 8:
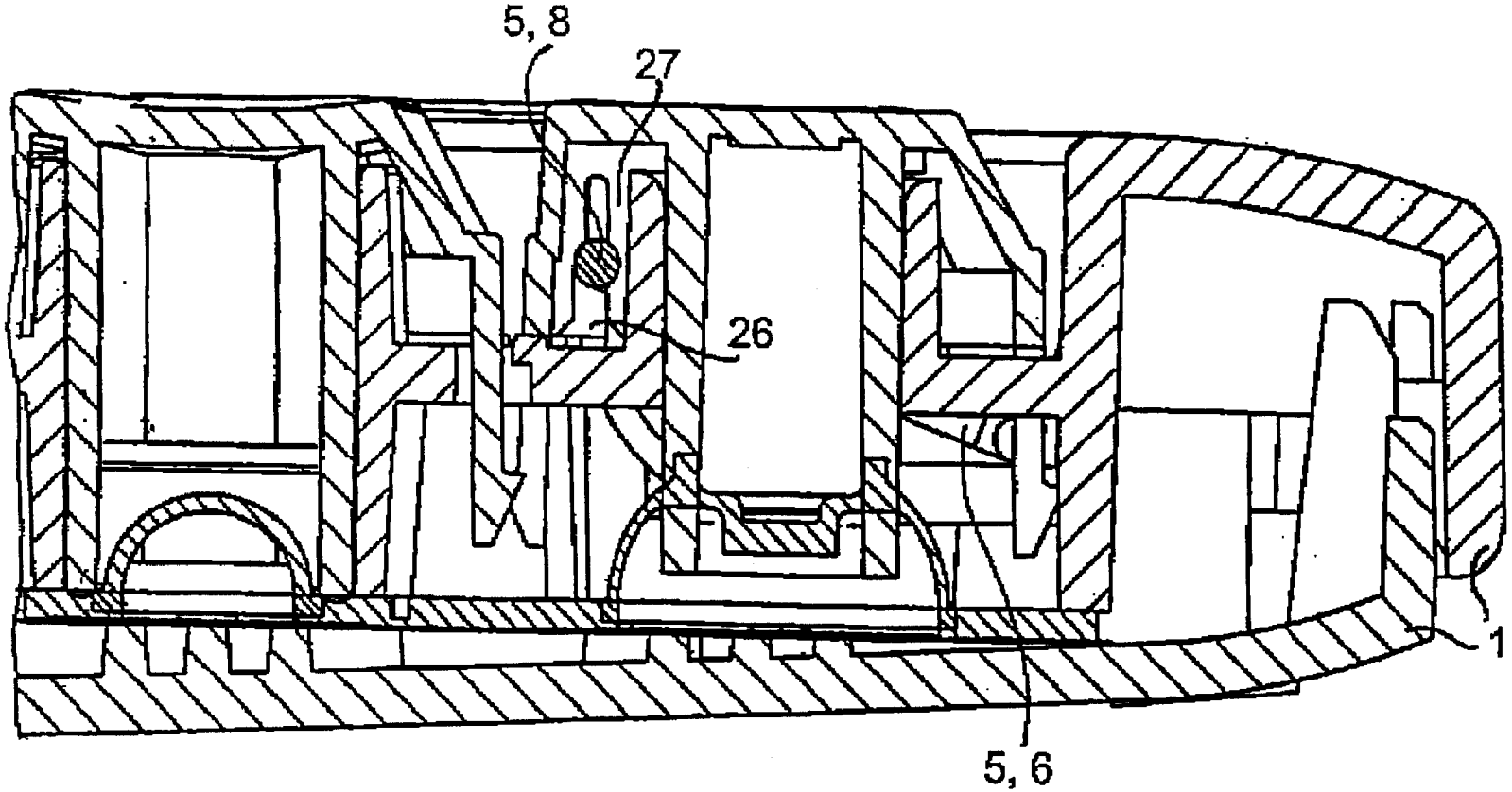
FIG. 8 shows a cross-sectional view through the keyboard fitted in finished condition, the sectional plane through the space bar being chosen to display how the swiveling crank arm latches into a snap-in aperture at one of the ends.

In the sectional view of FIG. 8, the same condition is illustrated as in FIG. 7, except in a different sectional plane. In this view it is clearly evident how, when multi-wide key body 25 is actuated, or in other words when all keys are pressed on at the same time after the combined injection-molding process has been completed, swiveling crank arm 5 together with its first crank-arm rod 8 latches into snap-in aperture 26 of bearing element 27 of multi-wide key body 25.

As FIGS. 1 to 5 show, the parallel guide of keyboard housing 1 is therefore configured such that swiveling crank arm 5 can be inserted precisely, thus ensuring that, during production of keyboards with automated machines, even multi-wide key bodies, which in the illustrated practical example are the key bodies for the space bar of a keyboard, can be accommodated in the injection-molding mold of the set of key bodies. All key bodies of the keyboard, including the space bar, are injection-molded in a one-shot process and, by means of a manipulator, are inserted directly from the injection-molding machine into keyboard housing 1 from above for the fitting operation, swiveling crank arm 5 then being disposed in its precise position illustrated in FIGS. 1 to 5. What is important in this connection is the geometry of the parallel guide, which bounds swiveling crank arm 5 in its longitudinal direction at both ends and by which the two support ribs 14 and 15 are so positioned in vertical direction that the position of the said swiveling crank arm corresponds to that of the depressed multi-wide key. If the complete set of injection molded key bodies is now inserted into keyboard housing 1 and pressed down as far as the end stop, swiveling crank arm 5, as illustrated in FIGS. 5 to 8, latches into the provided snap-in apertures 26 of multi-wide key body 25 and thus becomes functionally effective.

What is claimed is:

1. A keyboard housing assembly for a key array of a depressible-key keyboard, comprising:

a keyboard housing, and a swiveling crank-arm, the keyboard housing being adapted to accommodate at least one depressible multiwide key with a key body elongated in a longitudinal direction and having a first plunger adapted to be guided axially in a shaft of the housing against action of a spring, wherein the multi-wide key is adapted to be fastened, in a region of both of its longitudinal ends, to said swiveling crank-arm, said swiveling crank-arm having first and second crank-arm rods running parallel to the longitudinal direction and held at a fixed distance from one another by connecting elements, the first crank-arm rod being adapted to be mounted in bearing elements constructed as snap-in apertures on the key body, and the second crank-arm rod comprising two rod stubs, which are mounted in two lateral receiving elements of the keyboard housing, wherein the swiveling crank-arm is received in the keyboard housing so that its rest position prior to installation of the multiwide key corresponds to that position at which it is located when mounted in the bearing elements and with the multi-wide key body being depressed.

2. A keyboard housing according to claim 1, wherein the two lateral receiving elements are each provided respectively as a bearing for a rod stub of the swiveling crank-arm are configured such that the swiveling crank-arm has at both ends a limited range of movement in the longitudinal direction.

3. A keyboard housing according to claim 1, wherein at least two support ribs are provided in an upper region of the keyboard housing as rests for the swiveling crank-arm in its rest position.

4. A keyboard housing according to claim 3, wherein the two support ribs are disposed at such points in the upper region of the keyboard housing that the swiveling crank-arm together with its two axial end regions naturally rests on them.

5. A keyboard housing according to claim 4, wherein the two support ribs are disposed in such a way in the upper region of the keyboard housing that the two connecting elements of the swiveling crank-arm naturally rest on them at points disposed close to or directly underneath the first crank-arm rod.

6. A keyboard housing according to claim 1, wherein the two lateral receiving elements constructed respectively as horizontal parallel slideways for the two rod stubs of the swiveling crank-arm are provided with a lower horizontal slideway face and an upper horizontal slideway face respectively, which are spaced apart from one another by a distance corresponding to a thickness of the swiveling crank-arm, the two receiving elements are each provided with an L-shaped aperture, so that the respective rod stub of the swiveling crank-arm can be introduced between the two slideway faces and, in an action simultaneously coordinated therewith, the connecting element of the swiveling crank-arm can be introduced in an oblique orientation, and wherein outer lateral edges of the two L-shaped apertures are so disposed that a distance between them corresponds to a length of the swiveling crank-arm in the longitudinal direction, or to a spacing between outsides of the connecting elements of the swiveling crank-arm.

7. A keyboard housing according to claim 1, wherein addition to the first plunger, auxiliary plungers guided axially in associated shafts of the housing are disposed on both sides of and parallel to the first plunger.

8. A keyboard housing according to claim 1, wherein measures concerning attachment of the multi-wide key body together with its swiveling crank-arm to the keyboard housing are provided in a region of its two ends and, in mirror-image manner relative to its central plane oriented perpendicular to the longitudinal direction.

9. A keyboard housing according to claim 1, wherein said snap-in apertures on the key body are arranged to receive said first crank-arm rod as said key body is depressed along said axial direction of the housing shaft.

* * * * *